US005113839A

United States Patent [19]

Hartmann et al.

[11] Patent Number: 5,113,839

[45] Date of Patent: May 19, 1992

[54] IGNITION SYSTEM FOR AN INTERNAL COMBUSTION ENGINE

[75] Inventors: Uwe Hartmann; Udo Mai, both of Untergriesbach; Roman Schichl, Passau, all of Fed. Rep. of Germany

[73] Assignee: Vogt Electronic AG, Erlau, Fed. Rep. of Germany

[21] Appl. No.: 574,150

[22] Filed: Aug. 29, 1990

[30] Foreign Application Priority Data

Aug. 30, 1989 [DE] Fed. Rep. of Germany ..... 3928726

[51] Int. Cl.[5] ..... F02P 3/04

[52] U.S. Cl. ..... 123/606; 123/414; 123/612; 123/634; 123/644; 315/209 T

[58] Field of Search ..... 123/606, 607, 637, 644, 123/414, 612, 634; 315/209 T

[56] References Cited

U.S. PATENT DOCUMENTS 3,394,689 7/1968 Bell ..... 123/637
3,757,755 9/1973 Carner ..... 123/414
4,138,977 2/1979 Grather et al. ..... 123/637
4,356,807 11/1982 Tokura et al. ..... 123/644
4,366,801 1/1983 Endo et al. ..... 123/606
4,502,454 3/1985 Hamai et al. ..... 123/634

FOREIGN PATENT DOCUMENTS 1603631 11/1981 United Kingdom ..... 123/637

*Primary Examiner*—Andrew M. Dolinar
*Attorney, Agent, or Firm*—Mason, Fenwick & Lawrence

[57] ABSTRACT

The ignition system consists of a free-running ignition final stage, a miniature induction coil, a static and/or dynamic determination of the ignition angle, and a power supply. The ignition final stage ensures that the ignition current is an alternating current and that the ignition energy is fed to the spark plugs in a current-controlled manner. The ignition point is determined by reading the ignition angle. The electrical supply to the entire ignition final stage and additional consumers in a motor vehicle is through a power supply that converts the current and voltage.

23 Claims, 9 Drawing Sheets t4
t1
t2
t3

$I_D$
$I_{CR}$
$I_{Drain}$
$I_{Diode}$ $U_B$
$U_D$
$U_{Drain}$

Fig. 9
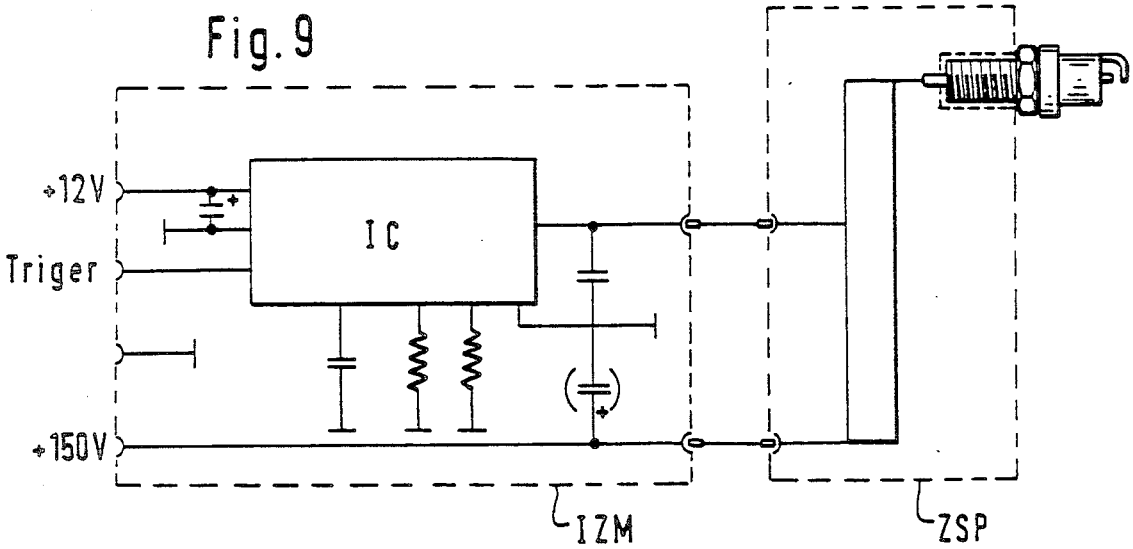
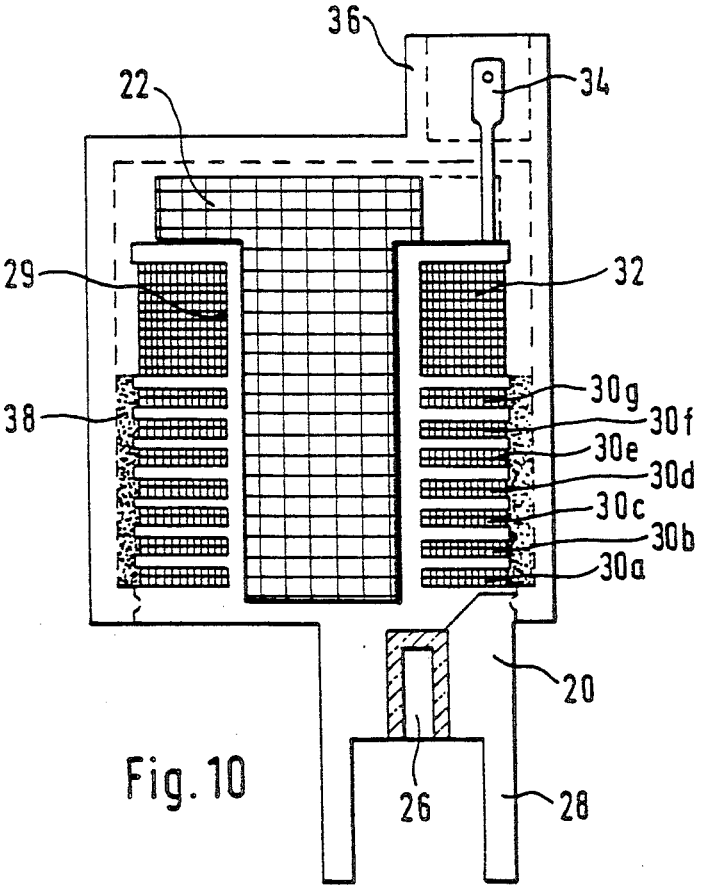
Fig. 10

IGNITION SYSTEM FOR AN INTERNAL COMBUSTION ENGINE

BACKGROUND OF THE INVENTION

The invention relates to an ignition system.

The use of alternating current for separate ignition in internal combustion engines is known. The use of alternating current for ignition has the advantage that the spark discharge at the spark plug can be maintained for any length of time so that the engine requirement at any point in time can easily be matched, increasing the efficiency of the internal combustion engine through more complete utilization of the fuel mixture and reducing the pollutants in the exhaust. DE-OS 1 539 183 shows an ignition system with a primary and secondary circuit of a step-up transformer, whose primary circuit is designed as a parallel and series resonance circuit. This resonance circuit, following a rapid discharge in the secondary circuit, generates an alternating current at the spark plug cathodes In addition, DE-OS 25 17 940 teaches a capacitor ignition system for internal combustion engines with ferromagnetic resonance in which a second control circuit generates an oscillating current in the primary and secondary windings only after each discharge of the primary capacitor, allowing an alternating current to flow for a predetermined period of time at the spark plug.

Another alternating current ignition system is described in DE-OS 29 34 573. In this ignition system, an oscillator circuit controls a transistor feedback circuit connected to the primary winding of an ignition coil. This oscillator circuit is controlled by the switch positions of the breaker contacts of an ignition distributor and generates an alternating current signal with constant frequency at the spark plugs.

One disadvantage of this known ignition system is that generating the alternating current signal assumes an input signal triggered by a starting pulse, necessitating additional circuit elements to generate the starting pulse.

Another disadvantage of these known ignition systems is that the energy supply is provided over a constant ignition interval, thus generating an alternating current signal with constant power at the ignition contacts. If the secondary circuit is not satisfactorily closed, for example if the mixture fails to ignite, if the ignition contacts are short-circuited, or if the spark plug connector become disconnected, this can lead to excessive power being supplied, which can result in damage or even destruction of the electrical components of the ignition system.

SUMMARY OF THE INVENTION

The goal of the present invention is to provide an ignition system of the species recited above which does not suffer from the listed disadvantages, and exhibits or permits the following characteristics:

1. The fuel mixture is ignited a short time after triggering, in a few microseconds if possible.
2. Combustion time adjustable at will.
3. Reliable static and dynamic triggering.
4. Combustion voltage tolerances which occur as a result of fluctuations in ionization as the ignition current passes through zero, vorticization, and pressure changes in the fuel mixture present in the cylinder, should have little or no effect on the combustion current.
5. High operating safety both in normal operation and in the case of malfunctions, for example if the spark plug output is open or shorted, over a wide range of temperatures.
6. Minor high-frequency problems.

This goal is achieved according to the invention.

According to the latter, the basic idea of the invention consists in connecting an ignition final stage (primary and secondary circuit) in such a way that it operates in a current-control blocking and conducting mode.

The blocking and conducting times of a switching transistor in the primary circuit of the final ignition stage is controlled as a function of the ignition energy consumed in the secondary circuit in such a way that when the energy consumption in the secondary circuit increases, the ignition current frequency increases as well and decreases when energy consumption falls. The control parameter which the on cycles of the transistor determine is the energy which is not completely drawn from the primary circuit by the secondary circuit with the constant energy supply to the output circuit being ensured by the current control at a resistor in the primary circuit. As a result, only as much energy is supplied to the primary and hence to the secondary circuit as is needed to generate an ignition spark and for control.

By using an energy recovery diode, the unused energy is recycled into the energy storage means (battery) resulting in lower consumption of electrical power.

Possible circuits are described hereinafter. In particular, two spark plugs may be ignited with one ignition final stage. In order to reduce the transient recovery time of the ignition final stage, the adjusting element that controls the energy supply (ohmic resistance) may be switched by additional circuit means.

The free-running ignition final stage (output circuit) consists of a switch (transistor), an energy recovery diode, a load coil, a primary resonant circuit capacitor, and a secondary circuit coil connected in series with a spark plug capacitor. The function of the output circuit is comparable to that of a band filter. Two electrical states are possible:

1. Ignition has not occurred:

In this case the secondary circuit, because of its approximately 50% coupling, is coupled supercritically with the primary circuit by the counter inductance. As a result the high voltage in the secondary circuit is available in full very rapidly within a few periods.

2. Ignition has occurred:

In this case the secondary circuit is loosely coupled by the strong damping with the primary circuit. This guarantees a nearly constant current supply which is almost independent of the ignition voltage.

The circuit according to the invention which, in the nonignited state, takes the spark plug capacitance into account, offers the following protections and possibilities:

a) The required ignition voltage amplitude is reached quickly, so there is no need for a distributor to connect the spark plug to the ignition voltage when or after it is reached.

b) For example if a spark plug connector has been pulled off, and there is no capacitance in the secondary circuit, the complete high voltage is not applied to the secondary output to protect the ignition coil, so that higher operating reliability of the ignition system is achieved.

c) With a spark plug short circuited or in the case of normal operation with different ignition voltages, the ignition current is always limited to a value that is harmless to the ignition system.

This technology using the previously described self-oscillating ignition stage permits considerable reduction of the volume of an ignition coil since the total ignition spark energy is fed to the spark plug over a longer space of time and because the transmission frequency is high and the circuit operates both in the blocked and conducting states.

Another advantage of this ignition final stage is that coupling of only about 50% is required to build up the ignition coil. This feature means that such a miniature ignition coil is economical and simple to manufacture.

Since every spark plug is provided with a miniature coil and since the circuit operates in the conducting and isolation transformer modes, high voltage is available practically immediately after triggering, so there is no difficulty in eliminating the distributor. Especially suitable, small, and efficiently, manufacturable ignition coils are also the subject of the invention.

The invention also proposes means for controlling, especially triggering, the ignition paths.

To trigger the individual ignition paths, various methods are known of themselves. Thus for example DE-OS 36 30 272 Al teaches a device for controlling an internal combustion engine in which the position of a transmitter disk connected with a shaft of the internal combustion engine, said disk having a hole designed as a mark, is recorded by a fixed recording segment. Using an inductively operating sensor, which operates for example by the eddy current principle, pulses are obtained which are evaluated electronically. A control and regulating circuit then uses these pulses to generate the on and off signals for the individual ignition branches. This known method is also suitable for triggering the high-frequency alternating current ignition. One disadvantage of the dynamic detection of the ignition time described above is that, to determine the position, the transmitter disk must move in order to determine clearly the position of the camshaft or crankshaft.

According to the proposal of the invention, a wheel is mounted on the camshaft to detect the correct triggering time for ignition, said wheel having a clearly identifiable code on its surface, said code being scanned by a sensor. The scanning by the sensor is inductive or optical for example. Thus for example a ten-bit Gray code can be placed on the peripheral surface of a camshaft wheel, said code being scanned by an inductive multifunction sensor with integral electronics and the position of the camshaft wheel supplies corresponding electrical signals. Improved resolution is achieved by making the code nonlinear, in other words by providing high resolution only in the vicinity of top dead center. This sensor and transmitter arrangement permits static and/or dynamic detection for example of the crankshaft angle, so that the position of the pistons and the ignition sequence for the individual cylinders of the internal combustion engine can be determined. Advantageously this permits self-starting without using a starting device, for example an electrical starter motor.

The components required for the ignition system according to the invention, especially for the control and regulating circuit and the sensor for static and/or dynamic determination of the crankshaft angle, can be powered in the conventional manner directly by means of a known low-voltage source, for example a 12 volt DC battery. The disadvantage of a low-voltage power supply like this one is that supplying electrical consumers that require a high operating voltage, such as headlights with high-pressure gas discharge bulbs or the ignition system described above, is possible only with an unsatisfactory degree of efficiency. This disadvantage can be overcome in a motor vehicle according to the invention in an advantageous manner by using a chopper-type power supply, in other words an inverter with a transformer. When a battery with a terminal voltage of 6 to 18 volts is used, output voltages of 150 volts for example can be obtained using the chopper-type power supply with better efficiency than when using a low-voltage power supply for the electrical consumers and their supply network in the motor vehicle.

BRIEF DESCRIPTION OF THE DRAWINGS

The invention will now be described in greater detail with reference to the embodiments in the drawing.

FIG. 9 is a schematic diagram of a complete ignition final stage according to one embodiment;

FIG. 10 is a partially cut-away side view of an assembled miniature ignition coil according to one embodiment;

Figure 1:
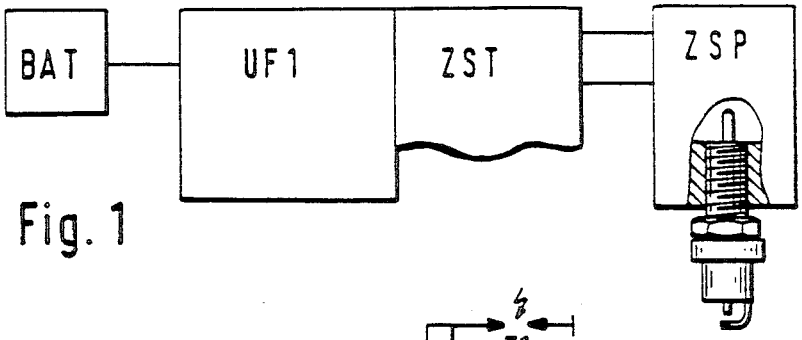
FIG. 1 is a schematic overall view of the ignition system according to the invention.

The ignition system according to the invention consists of the components shown schematically in FIG. 1 namely

DETAILED DESCRIPTION OF THE PREFERRED EMBODIMENTS a low-voltage power supply (BAT)
a central chopper-type supply (UF1)
high-voltage generating ignition final stages (ZST) corresponding to the number of cylinders
and miniature ignition coils (ZSP) for each spark plug.

Figure 2A:
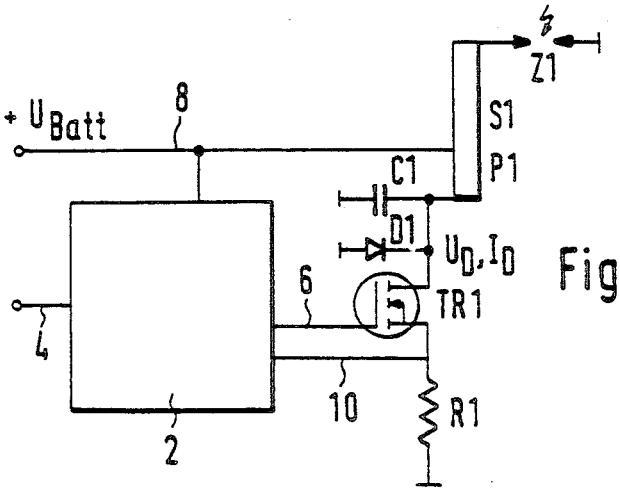
FIG. 2*a* is a circuit for an ignition final stage according to a first embodiment.
Figure 2B:
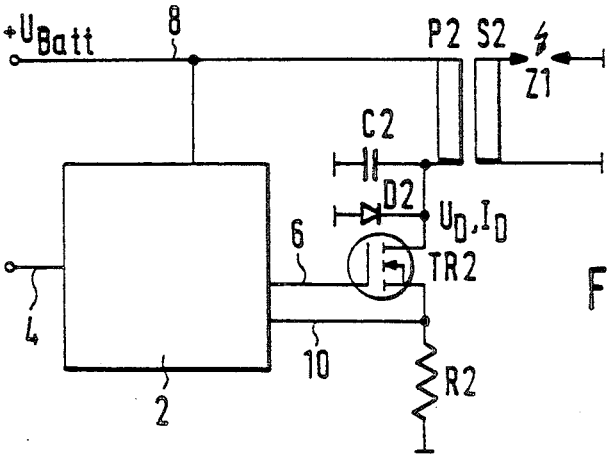
FIG. 2*b* is a circuit for an ignition final stage according to a second embodiment.
Figure 2C:
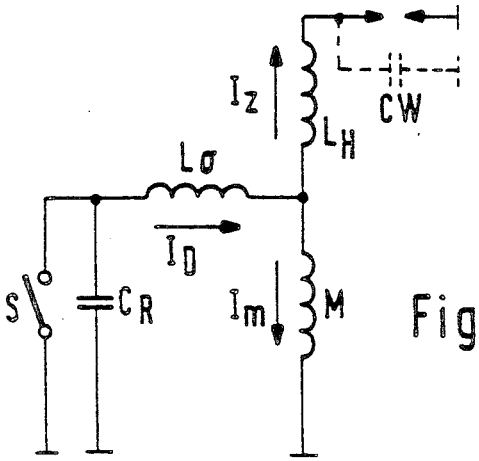
FIG. 2*c* is a substitute circuit diagram of the ignition final stages shown in FIGS. 2*a* and 2*b;*

The ignition final stage according to the invention shown in FIG. 2*a* consists of a primary resonant circuit and a secondary resonant circuit. The primary resonant circuit has a control and regulating circuit 2 with a trigger input 4, a trigger output 6 and a supply lead 8, as well as the primary winding Pl of an ignition coil. In series with primary circuit coil Pl is an resonant circuit capacitor Cl and parallel with it, an energy recovery diode Dl. A transistor TR1 is connected on the drain side with capacitor Cl and power recovery diode Dl. On the source side, transistor TR1 is connected to ground by a current-limiting resistor R1. A lead 10 connects the transistor on the source side with current-limiting resistor R1 and control and regulating circuit 2. On the secondary side, secondary coil (S1) is connected in series with the winding and ignition capacitor CW, as shown in the schematic in FIG. 2*c*. In the otherwise corresponding, embodiment shown in FIG. 2*b*, one output stage with electrically separated inductive decoupling is provided.

Figure 6:
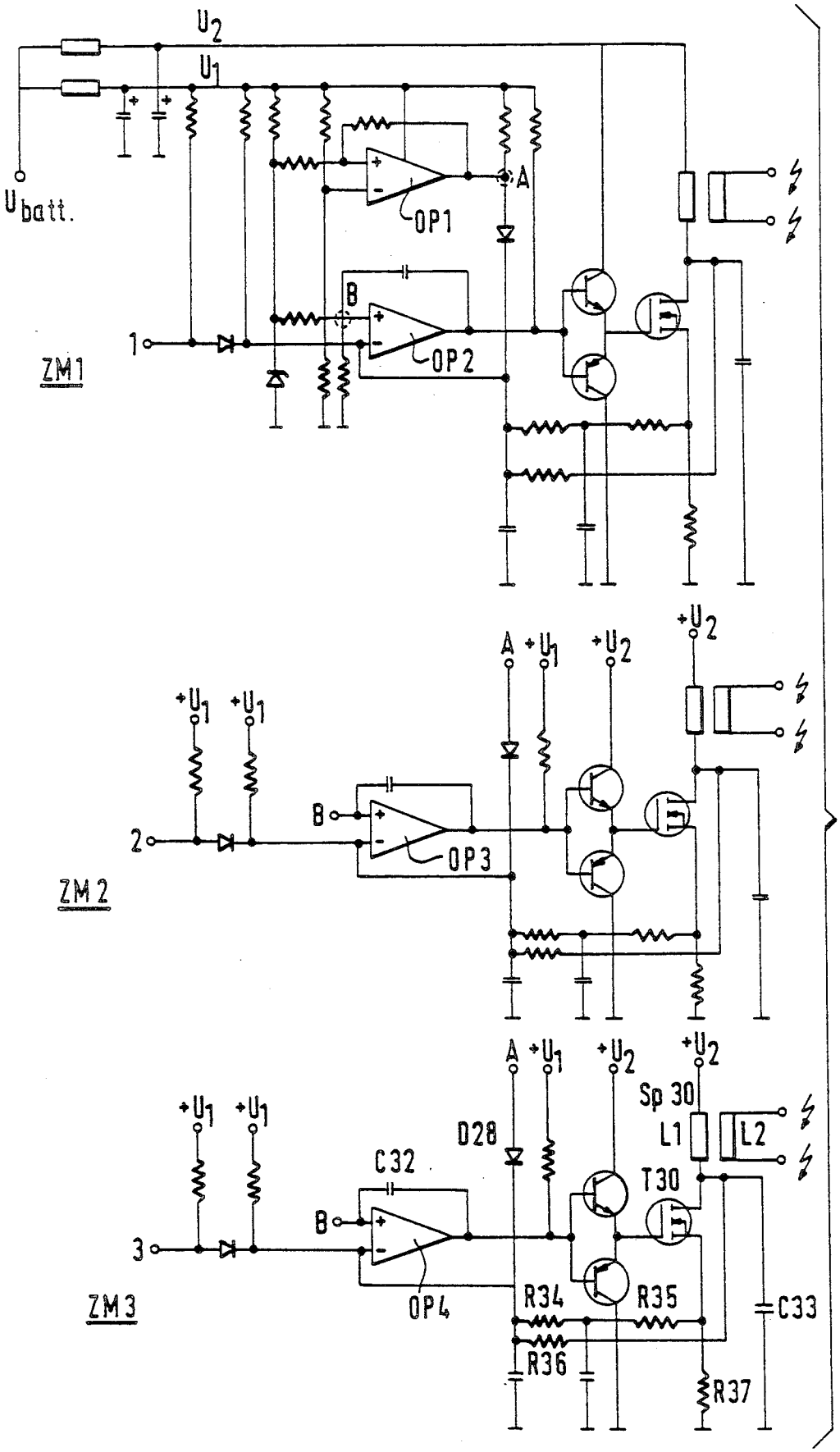
FIG. 6 is a schematic according to another embodiment for three ignition pathways for each two spark plugs.

A complete circuit for an ignition final stage with three ignition parts for each two spark plugs, in other words for a six-cylinder engine for example, is shown in FIG. 6.

Figure 3A:
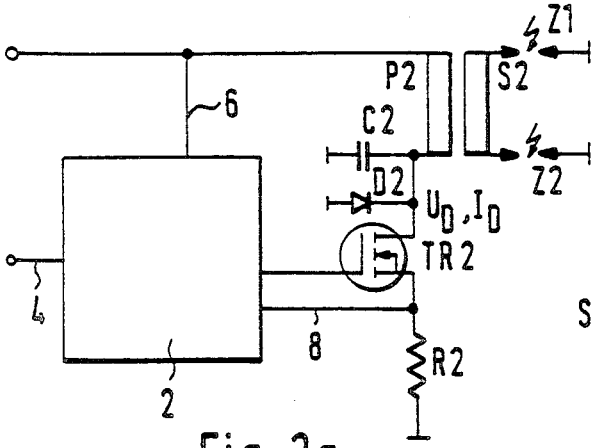
FIG. 3*a* is a schematic of an ignition final stage according to a third embodiment.
Figure 3B:
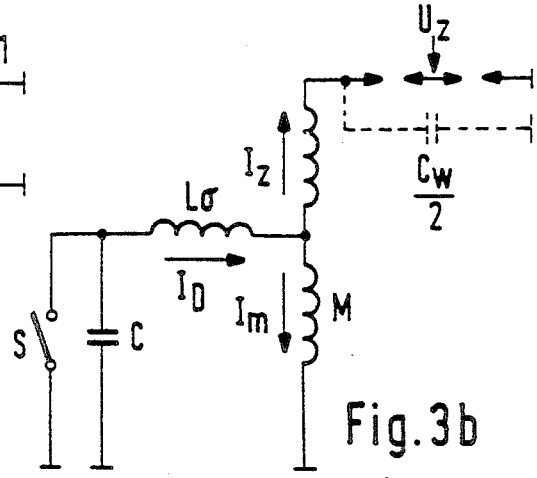
FIG. 3*b* is a schematic of the circuit shown in FIG. 3*a;*

Supplying two spark plugs Z1 and Z2 with a common ignition final stage is shown in FIG. 3*a*. With a secondary circuit wired in this fashion, the effective winding and spark plug capacitance CW is preferably reduced by a factor of 2, as shown in the schematic diagram in FIG. 3*b*.

Figure 4A:
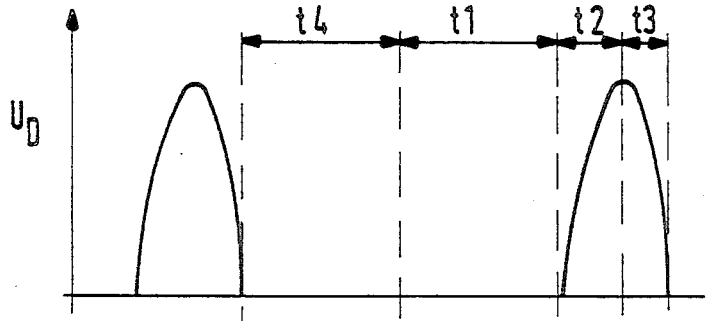
FIG. 4*a* is a graph showing the pattern of the drain voltage $U_D$ of switching transistor TR1 or TR2 in the circuits in FIGS. 2 and 3 as a function of time.

The theoretical function of the ignition final stage according to the invention is explained with reference to the graphs in FIGS. 4*a* to 4*c* and in FIGS. 5*a* to 5*c* for the above embodiments of the ignition final stages.

The function of the self-oscillating ignition final stage will be explained first for the non-ignited case (graph in FIGS. 4*a* to 4*c*).

Here we assume the steady state with sufficient battery voltage. The voltage at point A in the circuit according to FIG. 6 permits operation at the low level as soon as amplifier OP1 conducts. A trigger input, e.g. trigger input 3, is grounded in response to control. Since the reference voltage at point B is more positive than the voltage at the inverting input of amplifier OP4, transistor T30 conducts. Then a drain current $I_D$ begins to flow (FIG. 4*c*, time interval T1). The voltage drop at resistor R37 increases until the voltage at the inverting input (minus) of amplifier OP4 is more positive than the reference voltage at point B.

At this point transistor T30 is blocked. The energy contained in storage coil SP30 causes the entire output circuit to oscillate. A portion of the energy is transferred to capacitor C33 in the primary area (C1 and/or C2 in schematic diagram 2*c* or 3*b*) and the other part is transferred to capacitance CW in the secondary circuit (time interval t2, FIGS. 4*a* and 4*b*).

The voltage $U_D$ on capacitor C33 increases sinusoidally until no energy is left in the storage coil. During time interval T3 the capacitively stored energy is returned to inductance L1 until the voltage in capacitor C33 is equal to 0. At this point in time (start of time interval t4), storage coil SP30 delivers its available energy on the secondary side into circuit capacitor CW. On the primary side, this is not possible by analogy for C33 since the voltage $U_D$ at the drain of transistor T30 cannot go negative because the internal diode (energy recovery diode D1 or D2 in FIG. 2*a*, 2*b*, or 3*a*) conducts. The energy available in primary inductance L1 is returned through diode D30 to the on-board electrical system (time interval t4, see FIG. 4*c*).

Figure 4B:
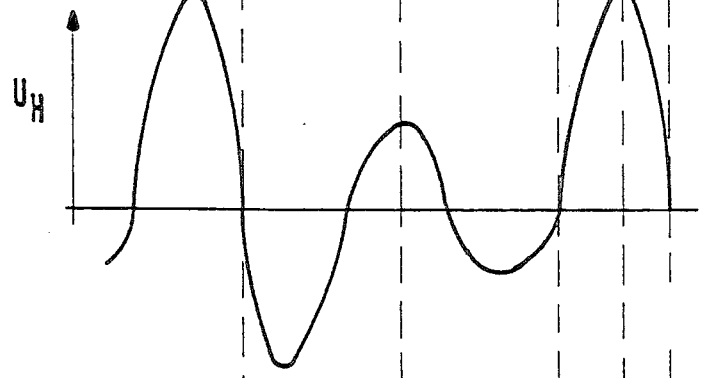
FIG. 4*b* is a graph of the secondary circuit voltage UH corresponding to the drain voltage according to FIG. 4*a* as a function of time.
Figure 4C:
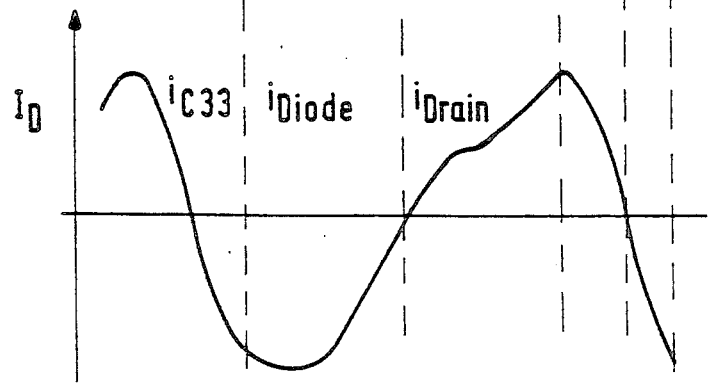
FIG. 4*c* is a graph of drain current $I_D$ of the switching transistor corresponding to the drain voltage shown in FIG. 4*a* as a function of time.

The secondary circuit can continue resonating during this time interval t4 (see $U_H$ in FIG. 4*b*). Its frequency is somewhat higher than before because the scattered inductance L (FIG. 2*c*, FIG. 3*b*) is now parallel to counter inductance M (see FIGS. 2*c* and 3*b*). During this time interval t4 transistor T30 conducts again because the same voltage conditions prevail as at the beginning of time interval t1. When the energy of inductance L1 has been discharged completely into the voltage source (on-board network), a new cycle begins.

In order to understand the circuit, it should be mentioned that transistor T30 is only blocked when the voltage at the inverting input (minus) of amplifier OP4 is more positive than the reference voltage at point B. This case always occurs when the charging current $I_D$ reaches a limiting value determined by resistor R37. This current control guarantees a constant energy supply to primary inductance L1, with the energy, apart from minor losses, being recycled completely into the on-board network in the event of failure to ignite. The blocked state of transistor T30 is maintained by the voltage drop across resistor R36 as long as voltage $U_D$ on the drain of transistor T30 is more positive than the battery voltage.

Figures 5A, 5B, 5C:
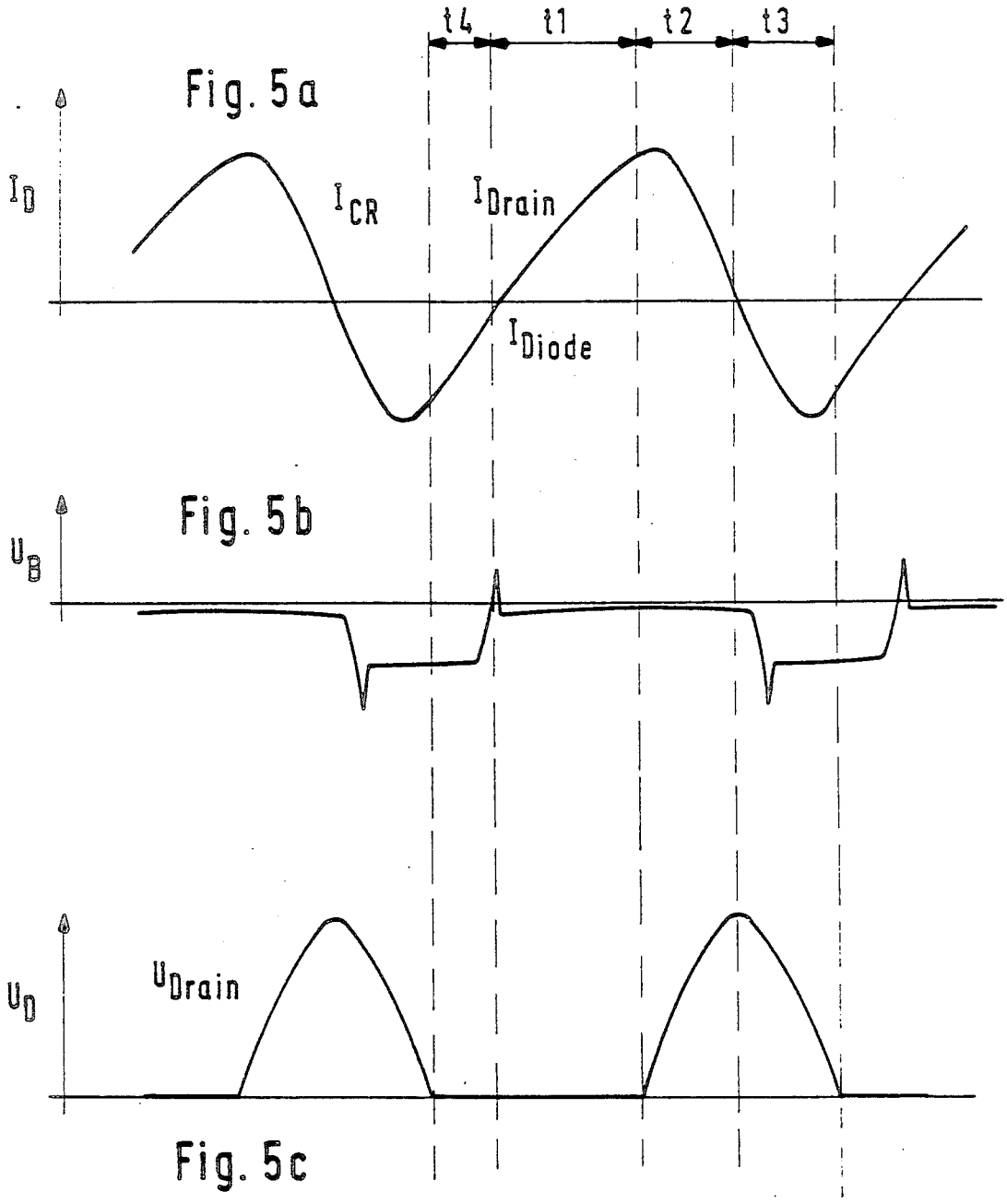
FIG. 5*a* is a graph of drain current $I_D$ of the switching transistor during ignition as a function of time.
FIG. 5*b* is a graph of arc voltage $U_B$ at the spark plug during ignition as a function of time.
FIG. 5*c* is a graph of drain voltage $U_D$ of the switching transistor during ignition as a function of time.

The described function of self-excitation does not change in the event of ignition, because the inductive coupling between the primary and secondary inductances amounting to about 50% prevents total damping of the primary circuit by the heavily damped secondary circuit. In the event of ignition, the following operation takes place:

Because of the ignition current now flowing through the spark plug, much less energy is returned from the voltage source, in other words into the on-board network (FIG. 5*a*). Time interval t4 decreases considerably. One advantage of this circuit design is that only as much energy is recycled as was present after the ignition phase.

This behavior makes it possible for the desired current supply to be largely independent of ignition voltage $U_B$ over a wide range. When ignition voltage $U_B$ is high, a large share of the energy in the light arc of the spark plug is converted into heat. In this case less residual energy is returned to the voltage source. Consequently, time interval t4 becomes shorter, the ignition frequency rises, and the current draw increases.

For the opposite case, in other words for low ignition voltage $U_B$, the opposite behavior applies, namely time interval t4 increases, the ignition frequency decreases, and the current draw declines.

In the embodiment described above, there are different primary and secondary circuit frequencies.

With suitable circuit design, for example the primary free running circuit frequency is about 18 kHz and the secondary circuit frequency is 43.5 kHz with an open primary circuit and 60 kHz with a shorted primary circuit.

The basic frequency with spark plug termination is about 20 kHz at an ignition voltage of 900 Vss.

Figure 7:
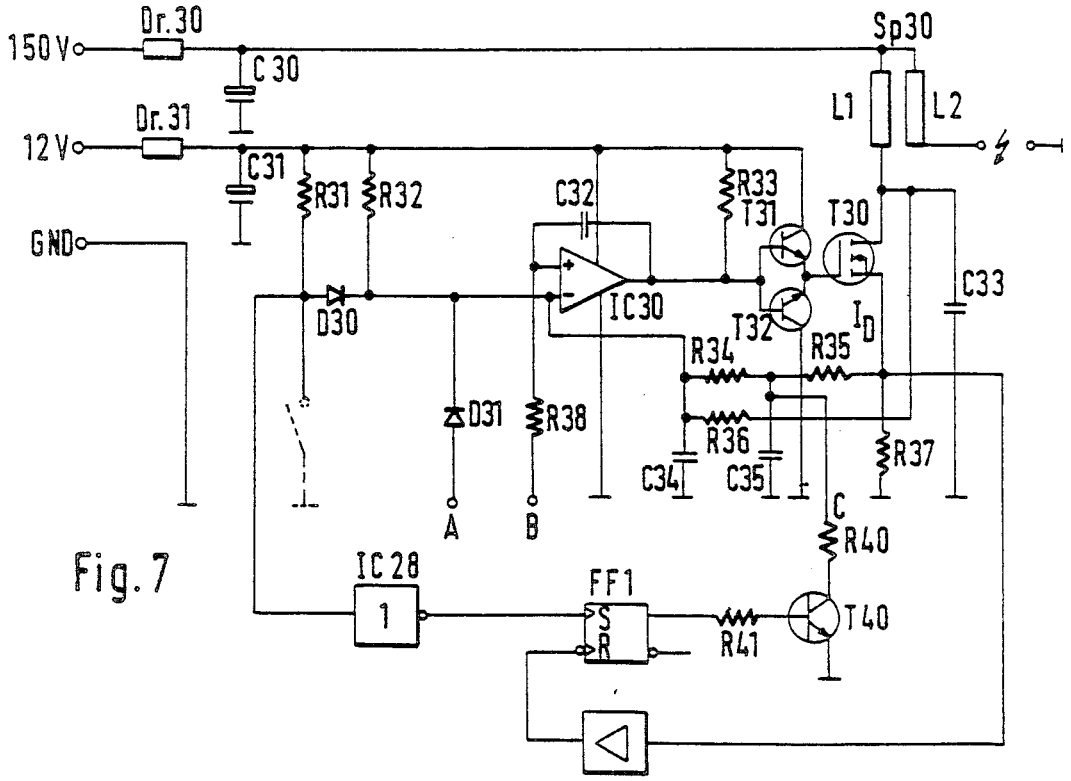
FIG. 7 is a schematic of an ignition final stage module according to one embodiment.

So that the high voltage be fully at the will available spark plug immediately after the on signal comes from the control and regulating circuit, it is advantageous if, for a specified time interval, drain current $I_D$ through the drain-source lead of transistor T30 is greater than in the completely steady state. To achieve this, in the circuit according to FIG. 7, using a bistable flip-flop FF1, which controls the gate of transistor T40, the actual measured value of the drain-current-proportional voltage at point C is reduced. The current amplitude is adjusted by resistor R40 so that the stored energy in primary inductance L1 is sufficiently high to replace the residual energy in the output circuit which is not present when the circuit is switched on. In this way the maximum high voltage $U_H$ is achieved even during the first oscillation period.

Flip-flop FF1 can be reset by the negative flank (reset flank) of the first current pulse. Resetting of flip-flop FF1 however can be made dependent on whether ignition has taken place or not. The information on this can be derived for example from the changing frequencies.

Figure 8:
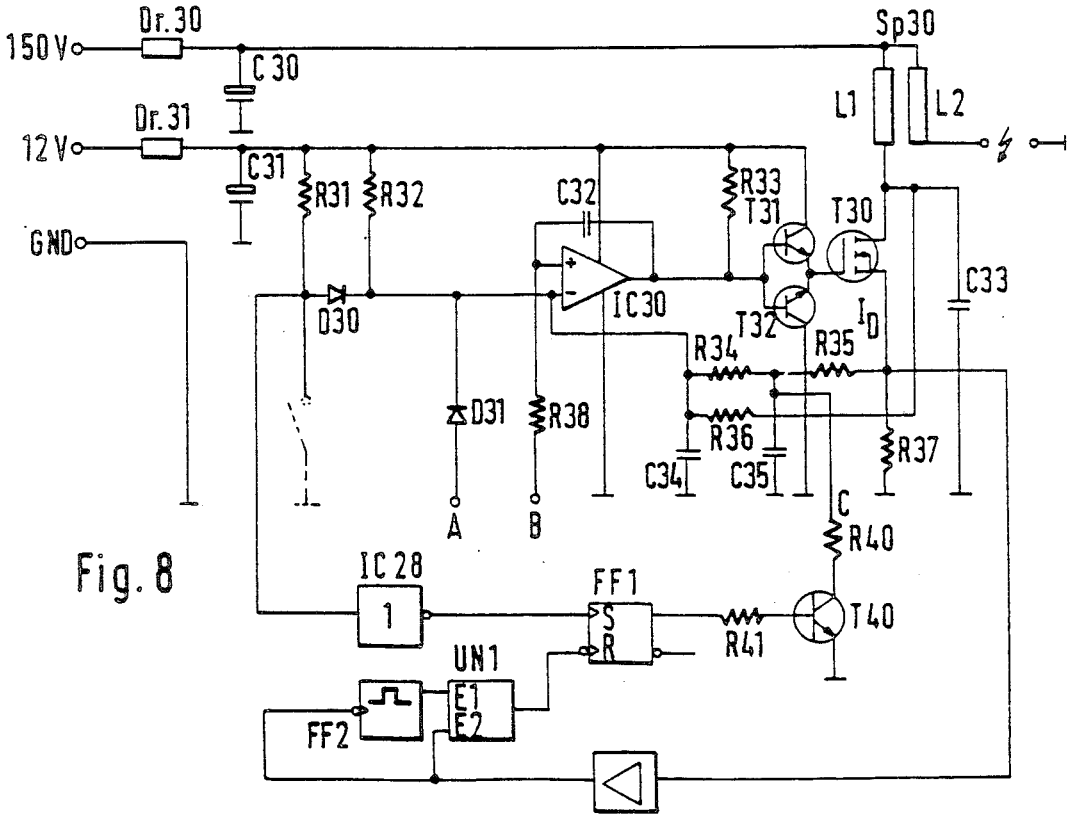
FIG. 8 is a schematic of an ignition final stage module according to another embodiment.

According to another preferred embodiment which is shown in FIG. 8, by means of an additional monostable flip-flop FF2, bistable flip-flop FF1 can be made to reset only during the time interval during which transistor current $I_D$ would flow, provided that ignition had occurred. This arrangement has the advantage that with very seriously contaminated spark plugs, ignition voltage $U_H$ increases further, providing a voltage reserve for heavily worn and contaminated spark plugs.

The overall design of an ignition final stage (see FIG. 9) with an ignition module IZM with integrated circuit and an ignition coil ZSP is shown in FIG. 9. The complete circuit of the ignition module with a high degree of integration thus permits economical manufacture and high operational reliability.

The miniature ignition coil used in cooperation with the ignition final stages mentioned above in an advantageous manner is shown in detail in FIGS. 10 and 11*a*–11*c*. The miniature ignition coil consists of three individual components, namely coil body 20, coil core 22, and coil housing 24. Coil body 20 has a cylindrical shape on one of whose end surfaces a plug-in socket 26 is integrally connected. This socket 26 is surrounded by a cylindrical wall 28 that acts a protective cap providing a positive and closely fitting seat on the spark plug.

Individual chamber segments 30*a* to 30*g* and 32 are formed on jacket surface 29 of coil body 20 by a plurality of circumferential segment ribs. Preferably, chamber segment 32 with the largest chamber rib interval 1 receives the coil winding of the low-impedance primary circuit coil, since the primary circuit is made with greater tolerances when forming the winding and can be made chamberless to improve space utilization. Preferably, the coil winding of the high-ohmage secondary coil is located in chamber segments 30*a* to 30*g* which are spaced closer together. One advantage of this chamber winding technique for the secondary circuit is that higher voltage strength is achieved and smaller winding tolerances are easier to achieve. Terminals 34 for the primary circuit are brought out at the end of coil body 20.

Figure 11A:
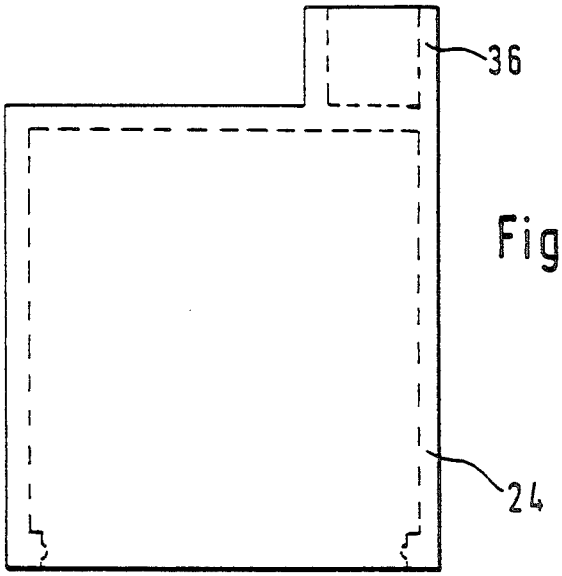
FIGS. 11*a*–11*c* show the individual parts of the ignition coil according to FIG. 10 in an exploded view, namely FIG. 11*a* the coil housing, FIG. 11*b* the coil core, and FIG. 11*c* the coil body.
Figure 11B:
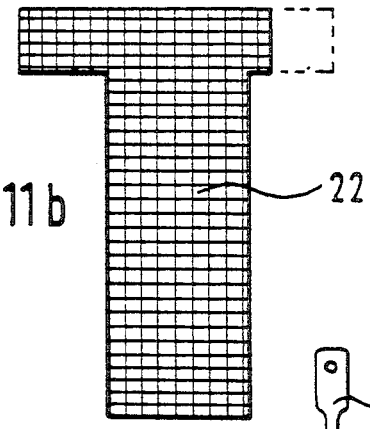
Figure 11C:
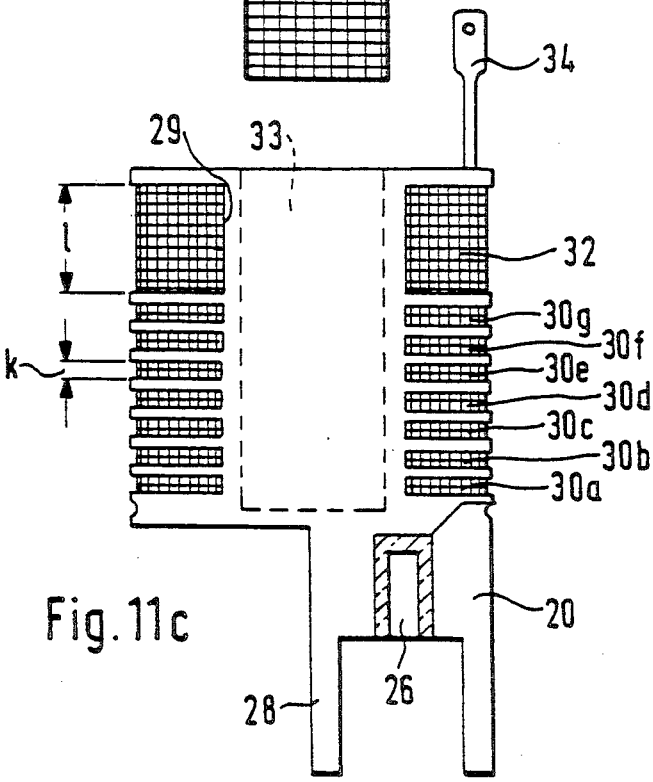

To receive coil core 22, coil body 20 has a concentric bore 33 (see FIG. 11*c*).

Coil core 22 is made mushroom- or T-shaped. This shape permits both simple installation and also provides magnetic shielding while increasing the Q factor of the primary circuit. Coil core 22 preferably is made of ferrite, which advantageously shows no saturation phenomena up to 200 C.

To hold coil core 22 in the coil body and to protect the coil windings, coil housing 24 for coil body 20 is made cap- or pot-shaped with coil core 22 in place (see FIGS. 11*a*). To protect the electrical leads against mechanical stress, a tubular stub 36 is mounted on coil housing 24 on its top lid.

In the end-mounted form (see FIG. 10), the coil body is potted in watertight fashion with coil housing 24, thereby advantageously increasing corrosion resistance. The potting compound 38 preferably extends over chamber segments 30*a* to 30*g* that receive the secondary windings. The potting material used is preferably composed of silicone. "Plastoferrit" is suitable for coil housing 24, enriched for example with conductive carbon black, whereby magnetic and electrostatic shielding is provided against external electromagnetic fields. Overall, the simple design of ignition coil 22 permits economical manufacture and the small volume of ignition coil 22 makes it possible to mount it directly on the spark plugs, increasing the operational reliability of the ignition system and resulting in low HF noise.

Figure 12:
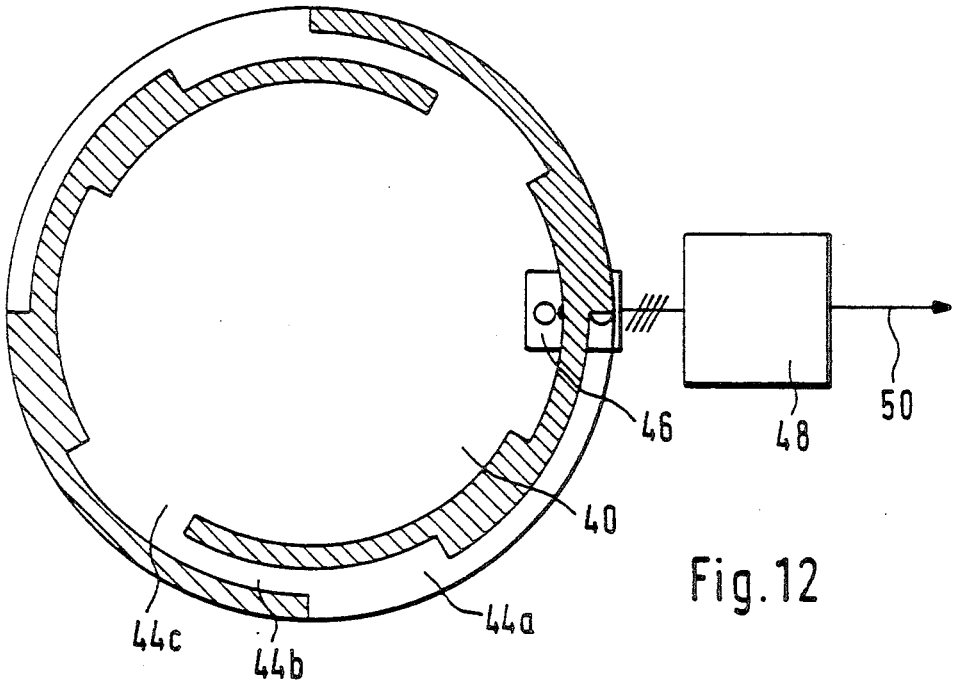
FIG. 12 is a schematic diagram of a trigger device for static and/or dynamic determination of the crankshaft angle according to one embodiment.
Figure 13:
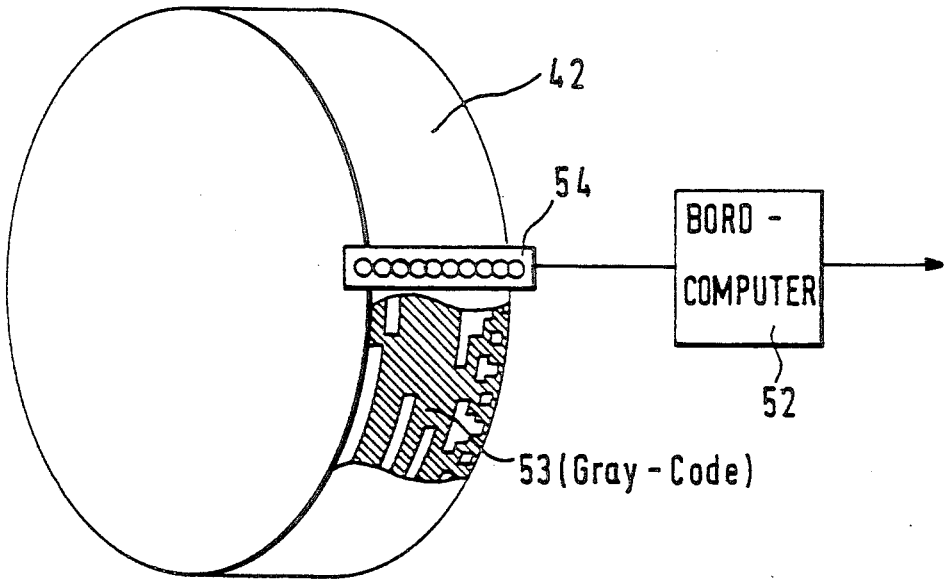
FIG. 13 is a schematic diagram of a trigger device for static and/or dynamic determination of the crankshaft angle according to another embodiment.

To trigger the individual ignition paths, the angular position of a crankshaft or camshaft is determined by means of a coding disk 40, 42 firmly connected therewith, as shown in FIGS. 12 and 13. FIG. 12 shows a code which can be used to trigger three ignition paths. The binary code of the radially disposed code tracks 44*a*, *b*, and *c* is read by an inductive sensor 46 and evaluated in electronics 48. This electronics provides at its output 50 the trigger signals required for the individual ignition paths. The code is advantageously designed in its phase position for the highest engine rpm, so that electronics 48 connected downstream, depending on the rpm, supplies the trigger signal to the ignition final stages on a delayed basis.

A fully digital circuit in which the ignition phase is directly evaluated by means of an on-board computer 52 is shown in FIG. 13. Code pattern 53 is located on jacket surface 42 of the code wheel nonrotatably connected for example with the camshaft. A ten-bit Gray code is used preferably as the code, and is read for example by an inductive multifunction sensor 54 or by an optical scanner. These signals are evaluated in a downstream integrated electronic circuit 52, for example an on-board computer, for determination for example of individual piston positions. This information is used to trigger the individual ignition final stages and also to meter and provide controlled direct injection of the fuel mixture into the cylinders.

Using a code wheel of this kind, the absolute position of the crankshaft or camshaft can be determined even statically, in other words in the resting position, which makes it possible to start the internal combustion engine from a resting position without using an electrical starting device (starter).

Figure 14:
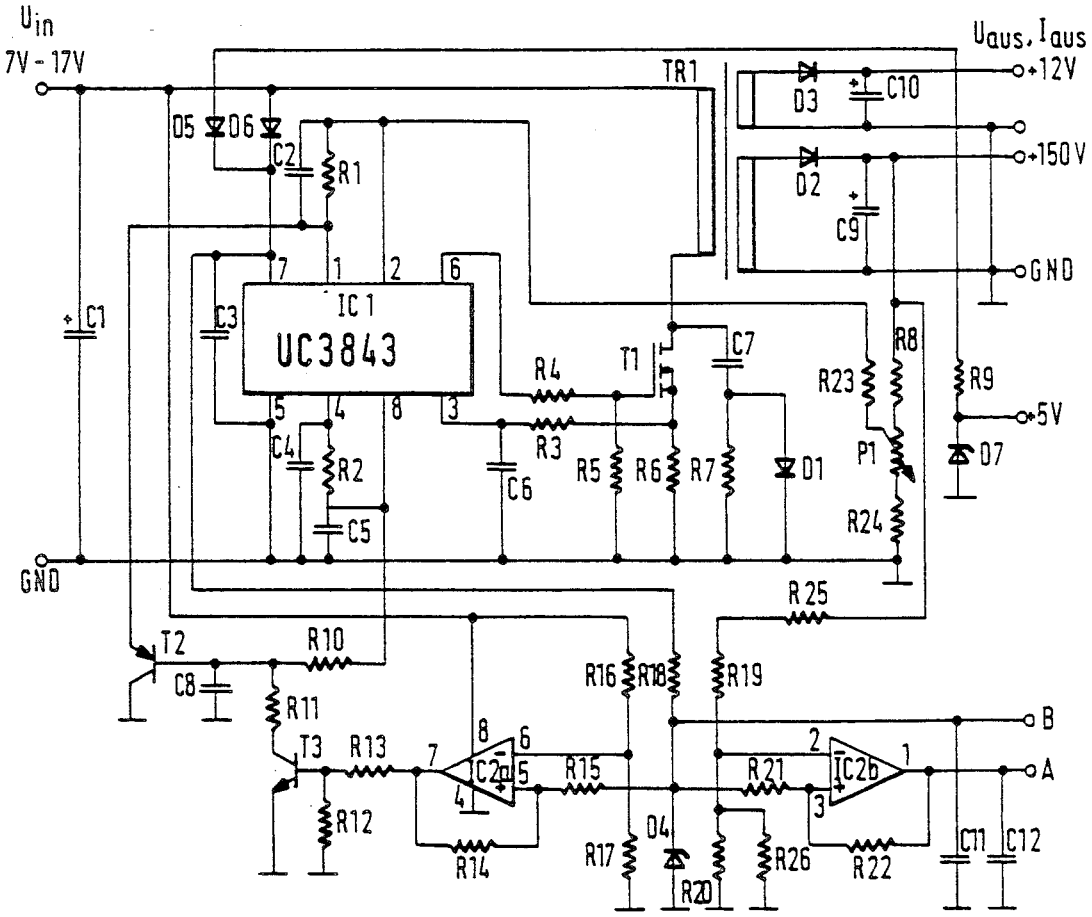
FIG. 14 is a schematic diagram of a chopper-type power supply.

The voltage and current supply for electrical devices can be provided by a chopper-type power supply (DC-DC converter). The schematic diagram of a preferred embodiment is shown in FIG. 14. It shows a known schematic diagram of a secondarily regulated single-ended isolated transformer.

We claim:

1. An ignition system for an internal combustion engine, comprising:

at least one DC voltage source, an ignition coil with primary and secondary windings, a controllable semiconductor switch between the ignition coil and the voltage source, a spark plug located in a circuit of the secondary winding, a first resonant circuit including the primary winding, and a capacitor connected in parallel with an energy recovery diode, a second resonant circuit including the secondary winding with its winding capacitance and the spark plug capacitance, the second resonant circuit including means for generating an alternating ignition current during an ignition phase, and a triggerable control and regulating circuit including means for controlling the semiconductor switch to interrupt the first resonant circuit in response to current in the first resonant circuit, wherein the first and second resonant circuits, in the manner of a bandpass filter, are coupled closely if ignition does not occur and coupled loosely if ignition has occurred.

2. The ignition system according to claim 1 wherein:

the primary winding is in series with a resonant circuit capacitor, an energy recovery diode, a transistor and a current limiting resistor, the transistor is connected on its drain side with the cathode of the diode and the capacitor, and on its source side with the resistor and a lead from the control and regulating circuit, the primary winding of the ignition coil is connected with the secondary winding, the secondary winding is connected in series with the spark plug, the spark plug having a capacitance, a power supply is located at an output of the DC voltage source, the primary winding is connected by a lead to the power supply and the control and regulating circuit, and the control and regulating circuit has a trigger input.

3. The ignition system according to claim 1, wherein the primary winding and secondary winding of the ignition coil are coupled inductively only.

4. The ignition system according to claim 1, further comprising first and second spark plugs having respective capacitances, wherein the secondary winding of the ignition coil is in series with the first spark plug's capacitance and the second spark plug's a capacitance.

5. The ignition system according to claim 1, further comprising:

an ignition final stage having an ignition module including:

a) at least one amplifier, b) a transistor, c) an energy recovery diode integrated into the transistor, d) an ignition coil, e) a primary circuit capacitor, and f) four resistors, wherein the inverting input of the amplifier is connected in series with a diode and a control lead, wherein the output of the amplifier controls the gate of the transistor through a driver stage, wherein the drain-source lead of the transistor is in series with the primary winding and a fourth of the four resistors, wherein the transistor is connected on the source side by the first and second of the four resistors in series with one another with the inverting input of the amplifier and the cathode of diode, wherein the transistor is connected on the drain side with coil winding with the capacitor and the third of the four resistors is connected with the internal energy return diode, and wherein the secondary winding of ignition coil is in series with two spark plugs.

6. The ignition system according to claim 1, wherein:

a first transistor and a second resistor are connected jointly with a third resistor in series with the drain-source lead of a transistor, the transistor is grounded on its source side, and the gate of the transistor is controllable from the output of a flip-flop by means of a fourth resistor, the flip-flop's control input being connected by a diode with the output of an inverting amplifier, the flip-flop's reset input being connected with the source side of the transistor by an amplifier, and wherein the flip-flop controls the transistor so that the transistor becomes conducting with the third resistor through its drain-source lead, so that electrical power output in the primary circuit is increased.

7. The ignition system according to claim 1, wherein:

a reset input of a bistable flip-flop is controlled by the output of an AND module, a first input of the AND module is connected by the output of a monostable flip-flop, and a second input of the AND module is connected with the input of the monostable flip-flop and the source side of a transistor through an amplifier so that bistable flip-flop is resettable as a function of the drain current of the transistor.

8. The ignition system according to claim 1, wherein the duration of the ignition current is reducible by raising the rpm of the internal combustion engine.

9. The ignition system according to claim 1, wherein the ignition current frequency is preferably higher than 16 Khz.

10. The ignition system according to claim 1, wherein the entire free-running ignition final stage consists of an integrated circuit and a miniature induction coil.

11. The ignition system according to claim 1, wherein the ignition coil includes a coil body made in one piece, a coil core made in one-piece, and a coil housing also made in one piece.

12. The ignition system according to claim 1, further comprising a mushroom-shaped coil core.

13. The ignition system according to claim 1, wherein a coil body is connected with a coil housing by a potting compound.

14. The ignition system according to claim 1, further comprising a coil body potted with potting compound in the vicinity of the secondary winding.

15. The ignition system according to claim 14 wherein the potting compound includes silicone.

16. The ignition system according to claim 1, further comprising a coil housing consisting of plastoferrit enriched with carbon black.

17. The ignition system according to claim 16, wherein the plastoferrit is enriched with conductive carbon black.

18. The ignition system according to claim 1, wherein a width of a chamber segment for the primary winding is greater than a width of chamber segments for the secondary winding.

19. The ignition system according to claim 1, wherein:

an ignition point and duration are derived from rotational speed and/or angular position of a crankshaft or camshaft, and a wheel is nonrotatably connected to the camshaft or crankshaft, the surface of said wheel having a code clearly identifying its angular position, the wheel being scanned by a sensor for generating signals that control the ignition by means of an electronic circuit.

20. The ignition system according to claim 19, wherein the code is nonlinear, with areas of high code resolution allocated to areas of the top dead centers of the pistons.

21. The ignition system according to claim 19, wherein the code is a one-step Gray code.

22. The ignition system according to claim 19, wherein a current and voltage inverter is used for a portion of the electrical supply for a motor vehicle.

23. The ignition system according to claim 22, wherein the voltage or current converter has input voltages in the 6 to 18 volt range and stabilized output voltages adjusted to needs of electrical consumers, especially in a range from 5 to 300 volts.

* * * * *